United States Patent [19]

Jameson

[11] 4,229,008

[45] Oct. 21, 1980

[54] BOARD GAMES FOR PLAYING DRAUGHTS AND CHESS

[76] Inventor: Michael J. Jameson, 21 Upper Lattimore Rd., St. Albans, Hertfordshire, England

[21] Appl. No.: 946,637

[22] Filed: Sep. 28, 1978

Related U.S. Application Data

[63] Continuation of Ser. No. 787,021, Apr. 13, 1977, abandoned.

[30] Foreign Application Priority Data

Apr. 15, 1976 [GB] United Kingdom ..... 15601/76

[51] Int. Cl.[3] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| 1,704,819 | 3/1929 | Beaman | 273/261 |
| 3,843,130 | 10/1974 | Whitney | 273/261 |
| 3,963,242 | 6/1976 | Treugut | 273/261 |
| 3,998,464 | 12/1976 | Poturalski | 273/261 |
| 4,045,030 | 8/1977 | Strozewski | 273/261 |

FOREIGN PATENT DOCUMENTS

| | | | |
|---|---|---|---|
| 557830 | 12/1943 | United Kingdom | 273/262 |
| 616572 | 3/1949 | United Kingdom | 273/261 |
| 1001122 | 8/1965 | United Kingdom | 273/262 |

*Primary Examiner*—Richard C. Pinkham
*Assistant Examiner*—R. Carl Moy
*Attorney, Agent, or Firm*—Oblon, Fisher, Spivak, McClelland & Maier

[57] ABSTRACT

Apparatus for playing a game which apparatus comprises a playing surface having marked thereon a plurality of unit areas aligned in three intersecting mutually inclined sets of parallel lines to form a triangular lattice array with the unit areas being spaced apart from each other, in which a first set of unit areas constituted by unit areas separated from each other by two unit areas in each of said lines is distinguished from the remaining unit areas, and at least two distinguishable sets of playing pieces each adapted to be moved over the playing surface from one unit area to another.

7 Claims, 1 Drawing Figure

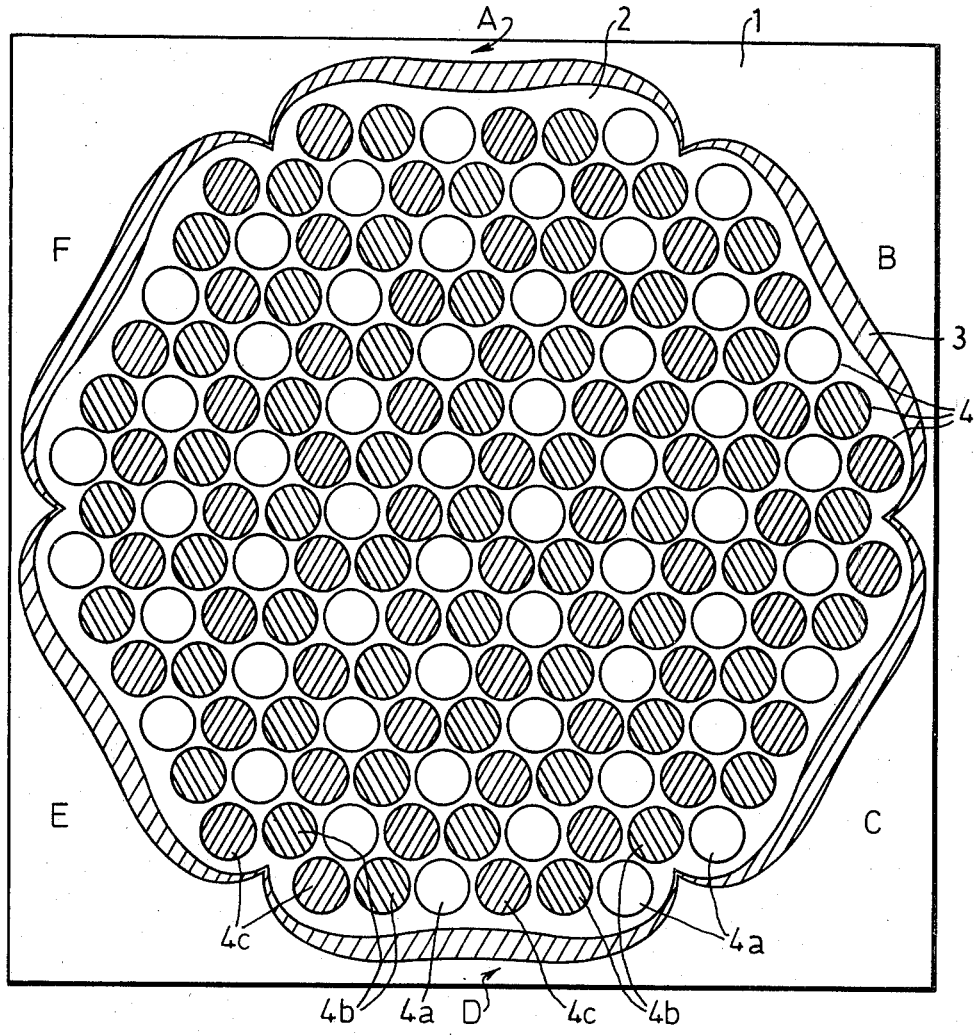
A
2
1
F
B
3
4
E
C
4c
4a
4b
4a
D
4c
4b

BOARD GAMES FOR PLAYING DRAUGHTS AND CHESS

This is a continuation of application Ser. No. 787,021, filed Apr. 13, 1977, now abandoned.

The present invention relates to a game in which two or more players each move in accordance with rules playing pieces on a playing surface in an endeavour to dominate with their playing pieces the playing pieces of their opponent(s).

According to the present invention, there is provided apparatus for playing a game, which apparatus comprises a playing surface having marked thereon a plurality of unit areas aligned in three intersecting mutually inclined sets of parallel lines to form a triangular lattice array, with the unit areas being spaced apart from each other, in which a first set of unit areas constituted by unit areas separated from each other by two unit areas in each of said lines is distinguished from the remaining unit areas, and at least two distinguished sets of playing pieces each adapted to be moved over the playing surface from one unit area to another.

In use, each player of the game, usually two or three, is allocated a set of playing pieces and the extent and direction in which those pieces can be moved are determined by rules of the game. The rules provide that in at least one version of the game to be played some at least of the playing pieces are constrained to move on the said first set of unit areas only. The rules can lay down other constraints upon movement of playing pieces and can specify the conditions under which a playing piece of one player can "take" or otherwise delay a playing piece of the other player(s). The object of the game is for each player to move his playing members to dominate the playing surface by removal and/or obstructing of his opponent(s) playing members.

Advantageously, the playing surface is provided on a face of a board which can be foldable for storage. Usually, the board will be polygonal such as rectangular, (including square) or hexagonal but the playing surface (i.e. area occupied by the unit areas) can be of a different outline shape. Preferably, the playing surface is hexagonal and each set of lines of unit areas is parallel with a respective pair of opposite sides of the hexagonal shape. In a particularly preferred embodiment, each side of the hexagon has six unit areas spaced apart therealong and without unit areas at the corners of the hexagon.

The unit areas are preferably equispaced apart to form a regular (i.e. equilateral) triangular array. In addition to the first set of unit areas, the areas can be divided into two further mutually distinguishable sets in which the unit areas are separated from each other by two unit areas. Each unit area can be a circle with the unit areas of the or each set distinguished by colour and/or design. For example when there are three sets of unit areas they can be coloured white, red and black respectively.

The playing members can be of any desired colour and/or shape provided that they can be moved from one unit area to another on the playing surface. Said playing members can conveniently be draughts pieces or chessmen. In a preferred embodiment, three sets of draughts pieces are provided for use in one version of the game and three sets of chessman for use in another version of the game, both versions using the same playing surface.

The following is a description by way of example only and with reference to the accompanying drawing of a preferred embodiment of apparatus in accordance with the present invention. In the drawing, the single FIGURE is a plan view of a board for playing a game in accordance with the present invention.

Referring to the drawing, apparatus for playing a game comprises a flat square board 1 having marked on the upper surface thereof a generally hexagonal playing surface 2 surrounded by a decorative border 3. The playing surface has 163 circles 4 marked thereon to constitute unit areas. These circles 4 are of identical size and are aligned in three intersecting mutually inclined sets of parallel lines parallel with respective pairs of opposite sides of the edges of playing surface 2. The lines within each set are equidistantly spaced apart and the spacing of each set is the same. Thus, the circles are disposed in an equilateral triangular lattice array. The circles are divided by colour coding into three sets of circles **4*a*, 4*b*, 4*c* in which the circles of each set are separated from each other by two circles in each line. For example, circles 4*a* can be white, circles 4*b* can be black and circles 4*c*** can be red; for convenience further reference to the circles will be by reference to said colours. In the case of the board illustrated in the drawing, there are 54 white, 55 black and 54 red circles.

Each sequence of positions of the same colour across the board in a straight line is termed a file and each sequence of positions immediately adjacent to each other in a straight line of different colours is termed a rank.

The apparatus includes also three sets of draughts pieces (not shown) and three sets of chessmen (not shown) from each of which chess sets one pawn is omitted and a bishop is added. All of the draughts pieces and chess pieces are of a size adapted to stand on the circles 4 and are colour coded, for example white, red and black to distinguish one set of draughts or chessmen from the other.

The board 1 can be used with two of the sets of draughts pieces to play "draughts" with two players. With the board orientated so that a white circle **4*a* is in the bottom right-hand corner of the playing surface 2 (as shown in the FIGURE) one set of draughts pieces are located on the respective black circles 4*b* of the lower four lines adjacent the side marked D and the other set on the respective black circles 4*b* of the upper four lines adjacent the side marked A. Each player is allocated one of the sets and they take turns to move one piece at a time using only the black circles 4*b* of the playing surface. The rules of the game are otherwise substantially as for conventional draughts with provision for "taking", "huffing" and "crowning" pieces. In this case, however, the crowning positions are the five black circles 4*b*** near the side of the board immediately opposite a player's own starting position. It should also be noted that there are three possible directions in which a man may be moved i.e. along any one of the three files of which the position occupied by a man is common. A man may only be moved forward but a crowned piece or king may also be moved backwards along any one of the three files common to the position occupied by the piece. In play for two players, a man on a starting circle may be moved two positions forward, in any direction whether or not the man has already been moved from a rear to a forward starting circle.

The board 1 can also be used with all three sets of draughts pieces to play "draughts" with three players in which case one set of said pieces initially occupy respective black circles **4*b* of the lower four lines. The second and third sets of pieces occupy respective black circles 4b** of the respective first four lines parallel to the side edges of the playing surface which alternate with the lower edge. Thus the second set are in lines parallel to and adjacent to the side marked F in the FIGURE and the third set are parallel to and adjacent to the side marked B in the FIGURE. The rules of movement of the pieces are generally as for the two player game referred to above. The players play in rotation clockwise round the board one move at a time. In this case, the crowning positions for the draughts adjacent side F are the five black circles near the side C and the crowning positions for the draughts adjacent side B are the five black circles near the side E. The crowning positions for the draughts adjacent side D are as for the game with two players.

The board 1 can further be used with two of the sets of chessmen to play "chess" with two players. In this case all of the circles 4 within the inner playing surface area are used. Initially, the chessmen are located on circles 4 in the four upper and lower lines respectively of the playing surface 2. The outermost line of six circles 4 on side D is fully occupied by bishop, rook, queen, king, rook and bishop in that order. The central black circle in the second line is occupied by a third bishop and the circles spaced from the central circle by one circle in the second line are occupied by knights. Thus one circle occupied by a knight is a white circle and the other circle occupied by a knight is a red circle. The six central circles of the third line are occupied by pawns and the central circle of the fourth line is occupied by the remaining pawn. The other player arranges his chessmen along the side A except that the queens and kings are opposite each other as for conventional chess.

The board moreover can be used with all three sets of chessmen for playing "chess" with three players. In this case, the chessmen are aligned in the order and relative disposition disclosed above except that the upper set is replaced by a pair of sets parallel to and adjacent alternate sides B and F of the playing surface. In this case, all three queens are on a white circle 4a and the three kings are on a black circle 4b. The first move is by the player with the white chessmen and thereafter the play is in rotation clockwise around the board each player making one move at a time as in conventional chess. The white pieces should be positioned adjacent side D, the red pieces adjacent side F and the black pieces adjacent side B.

The move allowed by the chessmen in the game according to the invention are as follows:

King can be moved to a position adjoining the one which he occupies of another colour on a rank, or to a nearest position of the same colour on a file, in any direction of which the position occupied by the king is common. Castling is not permitted.

Queen can be moved to a position of any colour, being one of those forming the file or rank in any direction of which the position occupied by the queen is common.

Rook can be moved to a position being one of those forming the rank in any direction of which the position occupied by the rook is common.

Bishop can be moved to a position being one of those forming the file in any direction of which the position occupied by the bishop is common. One bishop is thus always positioned on a white circle, a second bishop on a black circle and the remaining bishop on a red circle.

Knight can be moved like a rook one position and like a bishop one position, which final position must not adjoin the position from which the knight first moved, such movements constituting one move. As in conventional chess, a knight may jump over pieces occupying intervening spaces during its move.

Pawn when not making a capture, can be moved forward on the file one position at right angles to its own starting rank. Each pawn that is moved to the last position on its file of movement, that is, opposite its own starting position, can be promoted to a queen, rook, bishop or knight, without regard to the number of such pieces already on the board. A capture with a pawn can be made when the opposing man occupies the adjoining position forward on the rank in either direction of which the position occupied by the pawn making the capture is common. A pawn may be moved two positions forward at its first move the normal en passart rule being applicable as in the game of conventional chess.

Check and Checkmate (i) The king is "in check" if so placed that an opposing man (whether pinned or not) could capture him at his next move, other things being equal. The player may advise an opponent of this by saying 'Check'. 'Check' still applies in games for three players, if the other opponents' piece is made to give a discovered check to the first opponent king by the movement of the player's man. But the person so involved may only say 'Check' at the time of his own turn to become player in due course.

(ii) The king must neither be moved to a position on which he would be in check, nor must he be moved to any one of the positions adjacent to and guarded by the position occupied by an opposing king.

(iii) A checked king must be moved out of check, or the checking man must be captured, or the check must be parried by the interposition of another man, either of the same series as the king being checked or otherwise. In games for three players, the imperative to move out of check only applies if the king is still in check at the time of his own turn.

(iv) A player who makes a move that does not fulfil the conditions in (iii) above must retract that move and make another move which does so comply and if possible he must make the move with the man he has already touched in making the retracted move.

(v) Checkmate is a check from which the king cannot be relieved by any of the moves described in (iii) above. In games for three players checkmate may apply for a short time if there is an intervening player between the attacker and the mated king. There-fore the checkmate must be confirmed in all cases of chess for three players by taking it to the stage of actual capture of the king.

(vi) The fact of having announced a checkmate erroneously or of having made a mistaken capture of a king, which has to be retracted, shall not affect the after-course of the game.

Notation (i) Each spot on the board shown in the drawing is named, after the fashion of ordinary chess: the positions of the starting rank of men are named respectively (for each player):

QB1 QR1 Q1 K1 KR1 KB1 and the next rank's positions are named:

QKt1 Qo1 B1 Ko1 KKt1

(ii) Thereafter, in each file forward of these, the spots are named: "QB2, QB3, QB4," etc up to "QB8".

(iii) There are six "corner" positions, which are not covered by the above. These are all black, and are named after their position on "the clock" as:

"I, III, V, VII, IX, XI"

without any other letters at all.

(iv) If confusion is likely to arise, because a piece could be moved to more than one spot with a similar name, (e.g. with moves of a queen near the centre of the board), then a prefix is added according to the colour of the player whose starting rank it refers to:

"Q—(W)B3", or "Q—(R)B3", or "Q—(B)B3".

(v) Wherever possible, notation is used as for White's starting ranks of men which are located adjacent side D of the board.

(vi) "(R)", and "(B)" only refer to Red's or Black's notation as for games for three players. The same notation is used in describing the moves for two players, or in draughts in matches and tournaments played with the board shown in the drawing.

It will be appreciated that the invention is not restricted to the specific details described above and that numerous modifications and variations can be made without departing from the scope of the invention as defined by the appended claims.

What is claimed is:

1. A game board for playing draughts and chess, said board comprising a hexagonal playing surface having marked thereon 163 discrete unit areas aligned in three intersecting mutually inclined sets of parallel lines with the unit areas being spaced apart from each other by equal distances to form a regular equilateral triangular array, each set of lines of unit areas being parallel to a respective pair of opposite sides of said hexagonal playing area, each side of said hexagonal playing area having six unit areas spaced apart therealong, a single unit area being omitted from each of the corners of said hexagonal playing area and the unit areas being arranged in three mutually distinguishable sets so that in each set the unit areas are separated from each other in each of said lines by two unit areas belonging one to each of the other sets, the unit areas of said playing surface arranged in a plurality of files, each file beginning with a unit area along one side of said playing surface and ending with a unit area at the side opposed to said one side, each file having end unit areas of the same distinguishable set of unit areas at opposed sides of said playing surface, there being a total of eight unit areas of the same distinguishable unit area set as said file end unit areas arranged along each file.

2. A game board as claimed in claim 1, in which said board is foldable for storage.

3. A game board as claimed in claim 2, in which said board is rectangular in shape.

4. A game board as claimed in claim 1, in which said sets of unit areas are distinguished from each other by design.

5. A game board as claimed in claim 1, in which said unit areas consist of circles and in which said sets of areas are distinguished from each other by color.

6. A game board according to claim 1 further comprising:

said three mutually distinguishable sets of unit areas arranged in a plurality of ranks formed by lines of immediately adjacent unit areas parallel to the opposite sides of said board, wherein each rank along the sides of said board has an end unit area at opposite ends thereof with only the unit areas of two of said mutually distinguished sets being used at the rank end unit areas along the sides of said game board; and, a unit area of the third mutually distinguishable set not used at the ends of the ranks along the sides of said game board disposed at the geometric center of said playing surface.

7. A game board according to claim 6 wherein said unit areas at the ends of each rank along the sides of the game board are colored red and white, respectively, and the unit area at the geometric center of the playing surface is colored black.

* * * * *